US008456108B2

(12) United States Patent
Kimura et al.

(10) Patent No.: US 8,456,108 B2
(45) Date of Patent: Jun. 4, 2013

(54) LED LIGHTING APPARATUS

(75) Inventors: Kengo Kimura, Niiza (JP); Mitsutomo Yoshinaga, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 224 days.

(21) Appl. No.: 13/108,332

(22) Filed: May 16, 2011

(65) Prior Publication Data

US 2011/0285307 A1 Nov. 24, 2011

(30) Foreign Application Priority Data

May 24, 2010 (JP) ..... 2010-118240

(51) Int. Cl.
*H05B 37/02* (2006.01)

(52) U.S. Cl.
USPC ..... 315/307; 315/250; 315/276; 315/297

(58) Field of Classification Search
USPC ..... 315/246, 250, 276, 279, 291, 294, 315/297, 307–308, 311
See application file for complete search history.

(56) References Cited

U.S. PATENT DOCUMENTS

| | | | | |
|---|---|---|---|---|
| 8,344,657 | B2 * | 1/2013 | Zhan et al. | 315/302 |
| 2010/0019692 | A1 * | 1/2010 | Kimura | 315/294 |
| 2010/0213859 | A1 * | 8/2010 | Shteynberg et al. | 315/224 |
| 2011/0025217 | A1 * | 2/2011 | Zhan et al. | 315/219 |
| 2011/0037399 | A1 * | 2/2011 | Hung et al. | 315/219 |
| 2011/0121754 | A1 * | 5/2011 | Shteynberg et al. | 315/294 |
| 2011/0193494 | A1 * | 8/2011 | Gaknoki et al. | 315/297 |
| 2011/0194312 | A1 * | 8/2011 | Gaknoki et al. | 363/21.12 |

FOREIGN PATENT DOCUMENTS

| | | |
|---|---|---|
| JP | 2004-327152 | 11/2004 |
| JP | 2006-210835 | 8/2006 |
| JP | 2007-35403 | 2/2007 |
| JP | 2011-3326 | 1/2011 |

* cited by examiner

*Primary Examiner* — Jason M Crawford
(74) *Attorney, Agent, or Firm* — Oblon, Spivak, McClelland, Maier & Neustadt, L.L.P.

(57) ABSTRACT

An LED lighting apparatus includes a triac dimmer 3, a series circuit connected to the triac dimmer and including a primary winding P of a switching transformer T and a switching element Q1, the switching transformer having a plurality of windings, a controller 14 of the switching element, a rectifying-smoothing circuit of a voltage of a secondary winding S of the switching transformer, LEDs 1*a* to 1*n* connected to an output of the rectifying-smoothing circuit, a current detector 7 detecting a current of the, a voltage detector 11 configured to output a voltage detection signal of a voltage generated at one of the secondary winding when the first rectifying element is ON, the voltage at the secondary winding being proportional to the phase-controlled AC voltage, and an amplifier 13 amplifying a signal that is based on the current detection signal and voltage detection signal for the controller.

3 Claims, 7 Drawing Sheets

LED LIGHTING APPARATUS

BACKGROUND OF THE INVENTION

1. Field of the Invention

The present invention relates to an LED lighting apparatus for lighting a plurality of LEDs.

2. Description of Related Art

An example of the LED lighting apparatus for lighting a plurality of LEDs (light emitting diodes) is disclosed in Japanese Unexamined Patent Application Publication No. 2004-327152 (Patent Document 1).

FIG. 1 is a schematic view illustrating the LED lighting apparatus disclosed in Patent Document 1. This apparatus is a non-insulated LED lighting apparatus having a triac serving as a dimmer. In FIG. 1, the triac TR1 phase-controls an AC input voltage. The phase-controlled voltage from the triac TR1 is passed through a rectifier 107, is detected by a controller 114, and is converted by an RMS detector 105 into a target voltage Vref for an LED current to be supplied to an LED 102.

A comparator 109 finds an error between the target voltage Vref and a detected voltage representing an LED current detected by a detection resistor R1. In such a way as to minimize the error from the comparator 109, a PWM circuit 113 conducts PWM control on a switching element FET1.

In this way, the LED lighting apparatus according to the related art employs the triac TR1 to phase-control an effective input voltage and change an LED current, thereby dimming the LED 102.

SUMMARY OF THE INVENTION

Commercial power sources used in the world are 100 V, 110 V, 115 V, 120 V, 127 V, 220 V, 230 V, 240 V, and the like that vary from nation to nation and from area to area. Even in one nation or in one area, there is a case of using different power sources such as 110 V and 220 V, or 120 V and 220 V.

In addition, the commercial power sources generally involve variations of about ±10% in power supply depending on the capacities of power stations and power consumption that may change from time to time.

Under these circumstances, the LED lighting apparatus having a dimming function of the related art illustrated in FIG. 1 reflects a change in an effective input voltage on an LED current. As a result, the related art unavoidably reflects not only a change in an effective input voltage created by the phase-controlling triac TR1 but also a change in an AC input voltage itself on an LED current. This results in unintentionally fluctuating the brightness of LED 102 depending on the nation, area, or time period in which the LED lighting apparatus is used.

The present invention provides an LED lighting apparatus having a dimming function capable of dealing with input voltage variations and power source variations.

According to an aspect of the present invention, the LED lighting apparatus includes a triac dimmer configured to phase-control an AC input voltage at a given phase ratio and output a phase-controlled AC voltage, a series circuit connected to the triac dimmer and including a primary winding of a switching transformer and a switching element, the switching transformer having a plurality of windings, a controller configured to control ON/OFF of the switching element, a rectifying-smoothing circuit having a first rectifying element and a first smoothing element and configured to rectify and smooth a voltage generated by a secondary winding of the switching transformer, LEDs connected to an output of the rectifying-smoothing circuit, a current detector configured to detect a current passing through the LEDs and output a current detection signal, a voltage detector configured to output a voltage detection signal representative of AC input voltage, when the first rectifying element is ON, atone of the secondary winding and n-th order winding ($n \geqq 3$) of the switching transformer, the representative voltage based on a winding voltage generated at the secondary winding of the switching transformer or the n-th order winding and being proportional to the AC input voltage, and an amplifier configured to amplify a signal that is based on the current detection signal and voltage detection signal and output the amplified signal to the controller.

DESCRIPTION OF PREFERRED EMBODIMENTS

LED lighting apparatuses according to embodiments of the present invention will be explained in detail with reference to the drawings.

Embodiment 1

Figure 1:
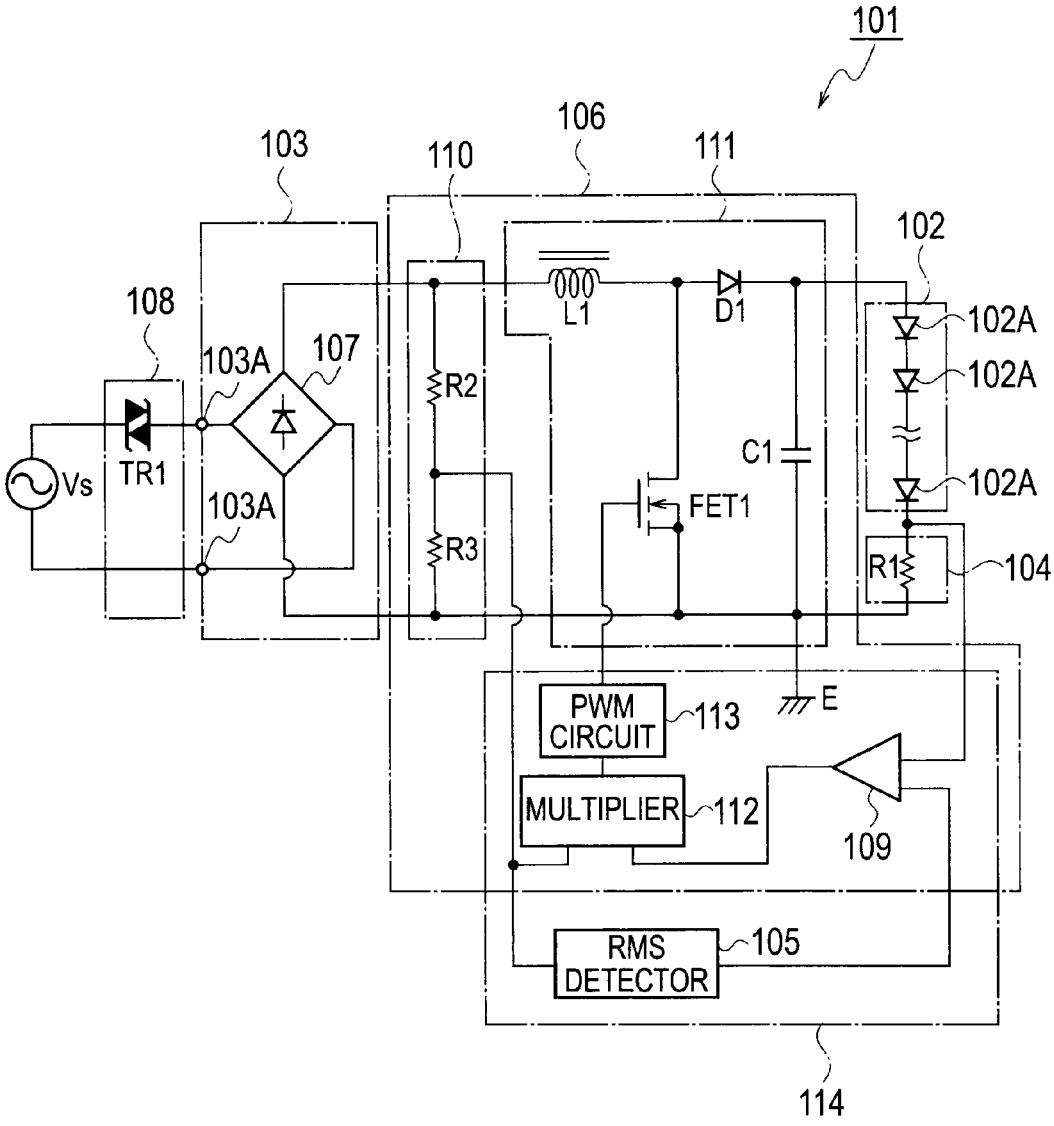
FIG. 1 is a schematic view illustrating an LED lighting apparatus according to a related art.
Figure 2:
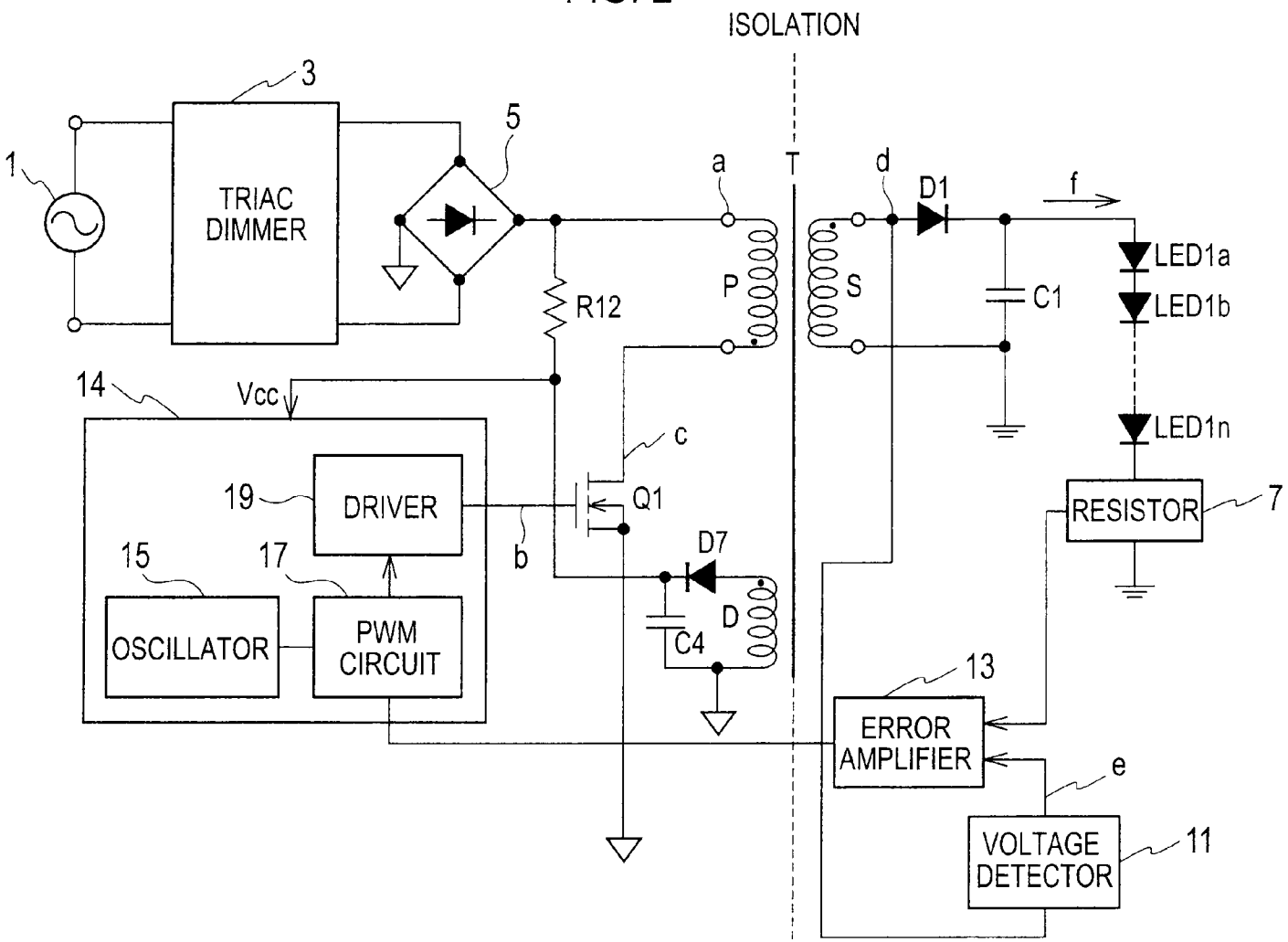
FIG. 2 is a schematic view illustrating an LED lighting apparatus according to Embodiment 1 of the present invention.

FIG. 2 is a schematic view illustrating an LED lighting apparatus according to Embodiment 1 of the present invention. This apparatus is an insulated LED lighting apparatus having a dimming function.

An AC power source 1 supplies an AC input voltage to a triac dimmer 3. The triac dimmer 3 phase-controls the AC input voltage based on a given phase ratio and outputs a phase-controlled AC voltage. A full-wave rectifier 5 rectifies the phase-controlled AC voltage.

Connected between an output end of the full-wave rectifier 5 and a primary ground is a series circuit including a primary winding P of a switching transformer T and a switching element Q1 that is, for example, a MOSFET. A controller 14 controls the switching element Q1 in a manner of PWM and includes an oscillator 15, a PWM circuit 17, and a driver 19.

A secondary winding S of the switching transformer T is wound in reverse phase with respect to the primary winding P. Both ends of the secondary winding S are connected to a series circuit including a diode D1 and a capacitor C1. The diode D1 (corresponding to the first rectifying element stipulated in the claims) and capacitor C1 (corresponding to the first smoothing element stipulated in the claims) form a rectifying-smoothing circuit. Connected between a connection point of the diode D1 and capacitor C1 and a secondary ground is a series circuit including series-connected LEDs 1*a* to 1*n* and a resistor 7.

The resistor (corresponding to the current detector stipulated in the claims) detects a current passing through the series-connected LEDs 1*a* to 1*n* and outputs a current detection signal to an error amplifier 13.

A voltage detector 11 outputs a voltage detection signal to the error amplifier 13. The voltage detection signal is based on a winding voltage induced at the secondary winding S of the switching transformer T when the diode D1 is ON and is proportional to a phase ratio of the AC voltage.

The error amplifier 13 performs a differential amplification of a signal of the current detection signal from the resistor 7 and the voltage detection signal from the voltage detector 11 and outputs the amplified signal to the PWM circuit 17. The PWM circuit 17 compares a reference signal from the oscillator 15 with the amplified signal from the error amplifier 13, and according to a result of the comparison, conducts PWM control to change an ON/OFF duty of a pulse signal, thereby controlling a current passing through to the LEDs 1*a* to 1*n* to a specific value. In response to the PWM signal from the PWM circuit 17, the driver 19 turns on/off the switching element Q1.

The switching transformer T also has a tertiary winding D that is inphase with respect to the secondary winding S and is electromagnetically coupled with the secondary winding S. Both ends of the tertiary winding D are connected to a rectifying-smoothing circuit including a diode D7 (corresponding to the second rectifying element stipulated in the claims) and a capacitor C4 (corresponding to the second smoothing element stipulated in the claims).

An output from the capacitor C4 as a power source is connected to the controller 14. Between the output of the full-wave rectifier 5 and the controller 14, a start-up resistor R12 is connected. At starting of the LED lighting apparatus, an output from the full-wave rectifier 5 is supplied through the start-up resistor R12 to the controller 14. Once the apparatus starts up, an output from the capacitor C4 is supplied to the controller 14.

Figure 3:
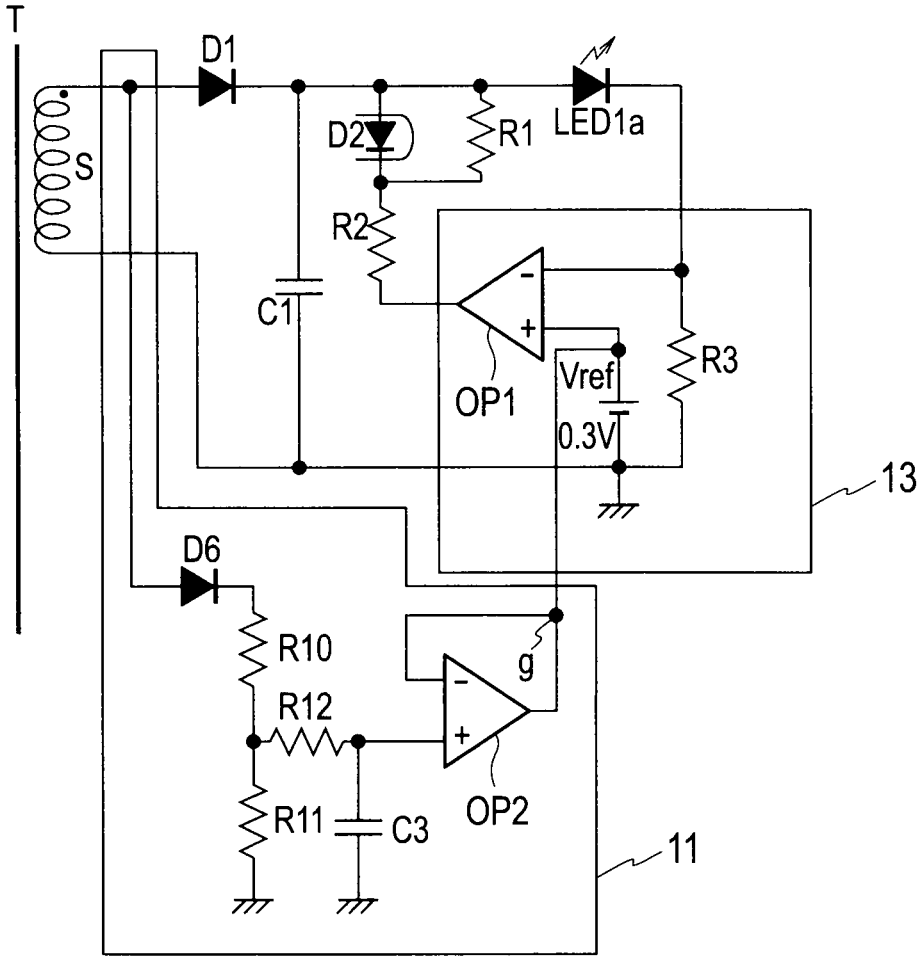
FIG. 3 is a schematic view illustrating a voltage detector and an error amplifier in the LED apparatus of FIG. 2.

FIG. 3 is a schematic view illustrating the voltage detector 11 and error amplifier 13 of the LED lighting apparatus. Both ends of the secondary winding S of the switching transformer T are connected to the series circuit including the diode D1 and capacitor C1. Both ends of the capacitor C1 are connected to the series circuit including the LEDs 1*a* to 1*n* and a resistor R3. In FIG. 3, the LED 1*a* is illustrated as a representative of the LEDs 1*a* to 1*n* of FIG. 2.

A connection point of the LEDs 1*a* to 1*n* and resistor R3 is connected to an inverting input terminal of an operational amplifier OP1. A non-inverting input terminal of the operational amplifier OP1 is connected to a reference power source Vref of, for example, 0.3 V. An output terminal of the operational amplifier OP1 is connected through a resistor R2 and a photodiode D2 of a photocoupler to a connection point of the diode D1 and capacitor C1. A signal of the photodiode D2 is transmitted to the PWM circuit 17. Both ends of the photodiode D2 are connected to a resistor R1. The operational amplifier OP1, resistor R3, and reference power source Vref form the error amplifier 13.

The secondary winding S of the switching transformer T is connected to a series circuit including a diode D6 and resistors R10 and R11 of the voltage detector 11. A connection point of the resistors R10 and R11 is connected to a series circuit including a resistor R12 and a capacitor C3. A connection point of the resistor R12 and capacitor C3 is connected to a non-inverting input terminal of an operational amplifier OP2. The other ends of the capacitor C3 and resistor R11 are grounded.

An inverting input terminal and output terminal of the operational amplifier OP2 are connected to the non-inverting input terminal of the operational amplifier OP1 and a positive electrode of the reference power source Vref.

Operation of the LED lighting apparatus having the above-mentioned structure will be explained in detail with reference to FIGS. 3 and 4.

Figure 4:
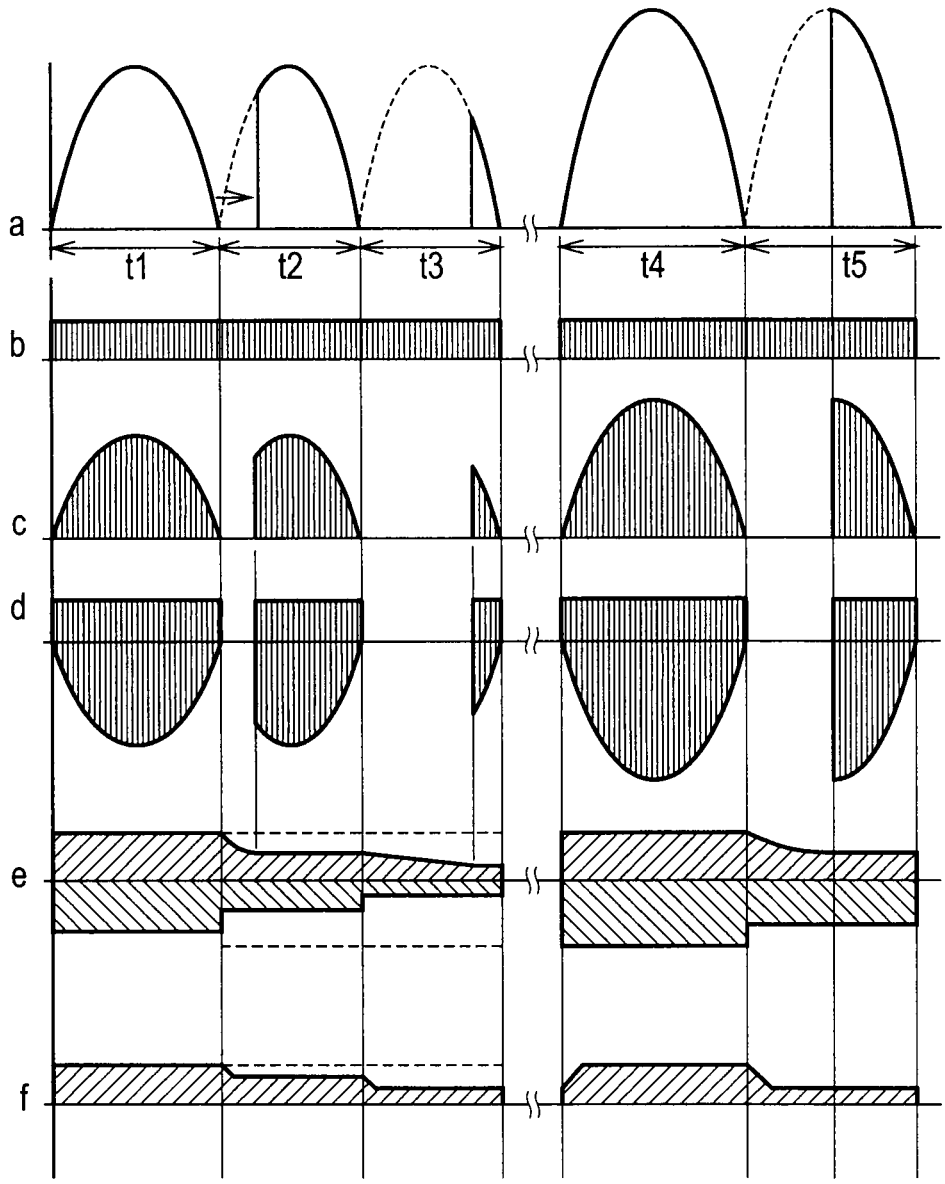
FIG. 4 is a graph illustrating operating waveforms of the LED lighting apparatus of FIG. 2.

FIG. 4 is a graph illustrating operating waveforms of the LED lighting apparatus according to the present embodiment. In FIG. 4, a waveform a is an output voltage waveform from the full-wave rectifier 5, a waveform b is a gate voltage of the switching element Q1, a waveform c is a drain-source voltage of the switching element Q1, a waveform d is a winding voltage of the secondary winding S of the switching transformer T, a waveform e is a smoothed voltage from the voltage detector 11 in periods t1 to t5, and a waveform f is an LED current when the LEDs 1*a* to 1*n* are dimmed according to a positive winding voltage of the secondary winding S.

In the periods t1 and t4, the triac dimmer 3 conducts no phase control, and in the periods t2, t3, and t5, the triac dimmer 3 conducts phase control. In the periods t4 and t5, the waveform a is larger than in the periods t1 to t3, i.e., the AC input voltage from the AC power source 1 to the triac dimmer 3 is larger in the periods t4 and t5 than in the periods t1 to t3. Under this condition, the triac dimmer 3 conducts phase control in the period t5.

In the periods t2 and t3, the output voltage a of the full-wave rectifier 5 is controlled by the triac dimmer 3. The drain-source voltage c is based on the gate voltage b from the controller 14 and the phase-controlled AC voltage (the output voltage a from the full-wave rectifier 5).

ON/OFF operation of the switching element Q1 produces the winding voltage d at the secondary winding S of the switching transformer T and the winding voltage d is asymmetric to a neutral level. The positive factor of the winding voltage is provided by the secondary winding S when the diode D1 is ON and is controlled to at specific level because it is used to turn on the LEDs 1*a* to 1*n*.

On the other hand, the negative factor of the winding voltage is provided at the secondary winding S when the diode D1 is OFF and varies in response to the AC input voltage. The positive and negative winding voltages occur at the secondary winding S during a period in which the triac dimmer 3 is conductive. The magnitude (absolute value) of the smoothed voltage e from the voltage detector 11 is smaller in the period t2 than that in the period t1 and is smaller in the period t3 than in the period t2.

Operation of the LED lighting apparatus when the switching element Q1 is turned on/off will be explained.

When the switching element Q1 is turned off, a side as depicted by a dot of the primary winding P of the switching transformer T becomes positive, a side depicted by a dot of the secondary winding S becomes positive, and thereby the diode D1 is turned on. As a result, the voltage of the secondary winding S clockwise passes a current through a path extending along the first end of S, D1, LEDs 1*a* to 1*n*, R3, and the second end of S, to turn on the LEDs 1*a* to 1*n*.

At this time, the positive high-frequency winding voltage generated by the secondary winding S passes through the diode D6 and is divided by the resistors R10 and R11. The divided voltage passes through the resistor R12 and is smoothed by the capacitor C3. The smoothed voltage of the capacitor C3 (for example, 0.1 V that is lower than the Vref of 0.3 V) is inputted into the non-inverting input terminal of the operational amplifier OP2 that is a voltage follower.

The positive high-frequency winding voltage (represented by the waveform d of FIG. 4) generated by the secondary winding S has a peak value that is the sum of a turn-on voltage of the LEDs 1*a* to 1*n* and a forward voltage of the diode D1. Generally, an LED element has an I-V characteristic that a forward current steeply changes with respect to a change in a forward voltage when a voltage applied to the LED element exceeds a specific ON voltage (a specific forward voltage) of the LED element. This means that, when the LED element is ON, a forward voltage is substantially constant without regard to a forward current (brightness). Namely, as long as the LEDs 1*a* to 1*n* are ON, the positive high-frequency winding voltage of the secondary winding S substantially has a constant peak value.

As mentioned above, a current passing through an LED element steeply changes with respect to a change in a voltage applied to the LED element when the voltage applied to the LED element exceeds the specific forward voltage of the LED element. This is due to the I-V characteristic of the LED element. Accordingly, even if the phase-controlled AC voltage (the output voltage a from the full-wave rectifier 5) varies in the periods t1 and t4, the peak value of the positive high-frequency winding voltage of the secondary winding S is substantially constant if no change is made in load, i.e., the LEDs 1*a* to 1*n*.

Consequently, a change in an input voltage effective value derived from phase control by the triac dimmer 3 is reflected on an LED current passing through the LEDs 1*a* to 1*n* and a change in an AC input voltage itself is not reflected on the LED current. The LED lighting apparatus according to the present embodiment, therefore, is capable of dealing with input voltage variations and a wide range of input voltages when dimming the LEDs 1*a* to 1*n* with the triac dimmer 3.

The output terminal of the operational amplifier OP2 outputs the smoothed voltage from the capacitor C3 to the non-inverting input terminal of the operational amplifier OP1. The operational amplifier OP1 operates to bring a voltage at the inverting input terminal thereof closer to the voltage (for example, 0.1 V) of the non-inverting input terminal, and therefore, the operational amplifier OP1 provides a low-level output to pass a current through a path extending along D2, R2, and OP1 and transmit an amplified signal corresponding to the current through the photodiode D2 to the PWM circuit 17.

When the diode D1 is ON, the smoothed voltage of the phase-controlled AC voltage is inputted into the non-inverting input terminal of the operational amplifier OP1, and therefore, a current corresponding to the smoothed voltage passes through the LEDs 1*a* to 1*n*.

When the switching element Q1 is turned on, the dot-marked side of the primary winding P of the switching transformer T becomes negative and the dot-marked side of the secondary winding S becomes negative, to turn off the diodes D1 and D6.

In this way, according to the LED lighting apparatus of Embodiment 1, the voltage detector 11 outputs a voltage detection signal to the error amplifier 13, wherein the voltage detection signal is proportional to the phase ratio of the AC input voltage, the AC input voltage is obtained by smoothing a high-frequency voltage which is generated at the secondary winding S of the switching transformer T when the diode D1 is ON and has a peak value substantially equal to or proportional to a voltage applied to the LED 1*a* to 1*n* as a load. Furthermore, the error amplifier 13 amplifies an error voltage between the voltage detection signal and a current detection signal of the resistor 7 (R3) and outputs the amplified signal to the controller 14. According to the signal of the error amplifier 13, the controller 14 controls ON/OFF of the switching element Q1.

As mentioned above, the LED lighting apparatus according to Embodiment 1 reflects a change in an input voltage effective value derived from phase control by the triac dimmer 3 on an LED current passing through the LEDs 1*a* to 1*n* and never reflects a change in an AC input voltage itself on the LED current. The LED lighting apparatus according to Embodiment 1, therefore, is capable of dealing with input voltage variations and a wide range of input voltages when dimming the LEDs 1*a* to 1*n* with the triac dimmer 3.

Embodiment 2

Figure 5:
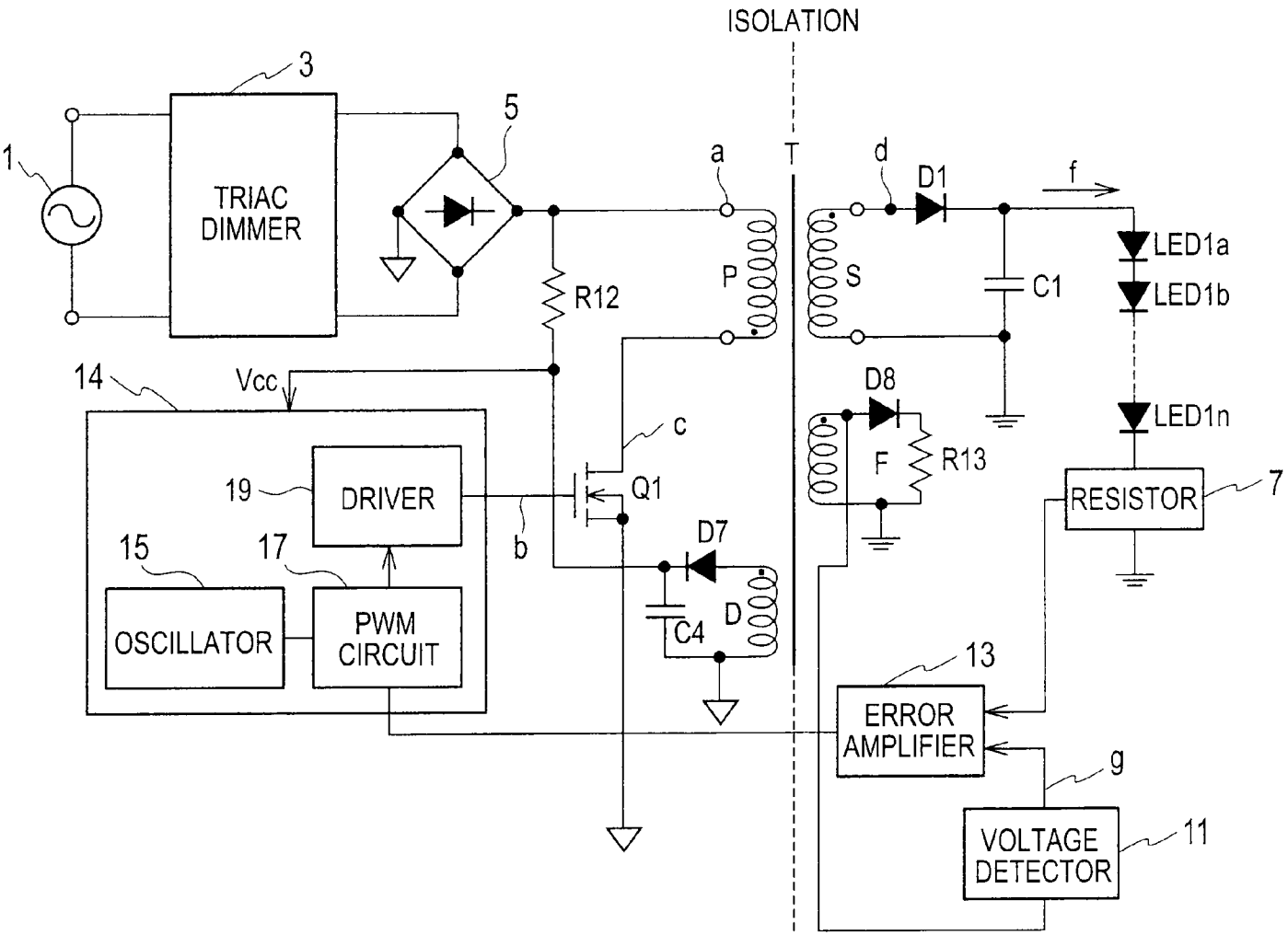
FIG. 5 is a schematic view illustrating an LED lighting apparatus according to Embodiment 2 of the present invention.

FIG. 5 is a schematic view illustrating an LED lighting apparatus according to Embodiment 2 of the present invention. Unlike the LED lighting apparatus of Embodiment 1 as illustrated in FIG. 2 that outputs a voltage from the secondary winding S to the voltage detector 11, the LED lighting apparatus of Embodiment 2 illustrated in FIG. 5 outputs a voltage from a quaternary winding F to a voltage detector 11 wherein the quaternary winding F is electromagnetically coupled with a secondary winding S and both ends of the quaternary winding F is connected to a series circuit including a diode D8 and a resistor R13.

In the LED lighting apparatus of the present embodiment, the quaternary winding F generates a voltage that is proportional to a voltage generated by the secondary winding S. Outputting the voltage of the quaternary winding F to the voltage detector 11 results in achieving operation and effect similar to Embodiment 1. If the number of LEDs connected in series as load is increased so that a very high voltage must be applied to the secondary winding S, a diode D6 in the voltage detector 11 will have a risk of breakage. Arranging the quaternary winding F whose number of turns is smaller than that of the secondary winding S prevents the breakage of the diode D6. According to Embodiment 2, the diode D8 may be used for the diode D6.

Embodiment 3

Figure 6:
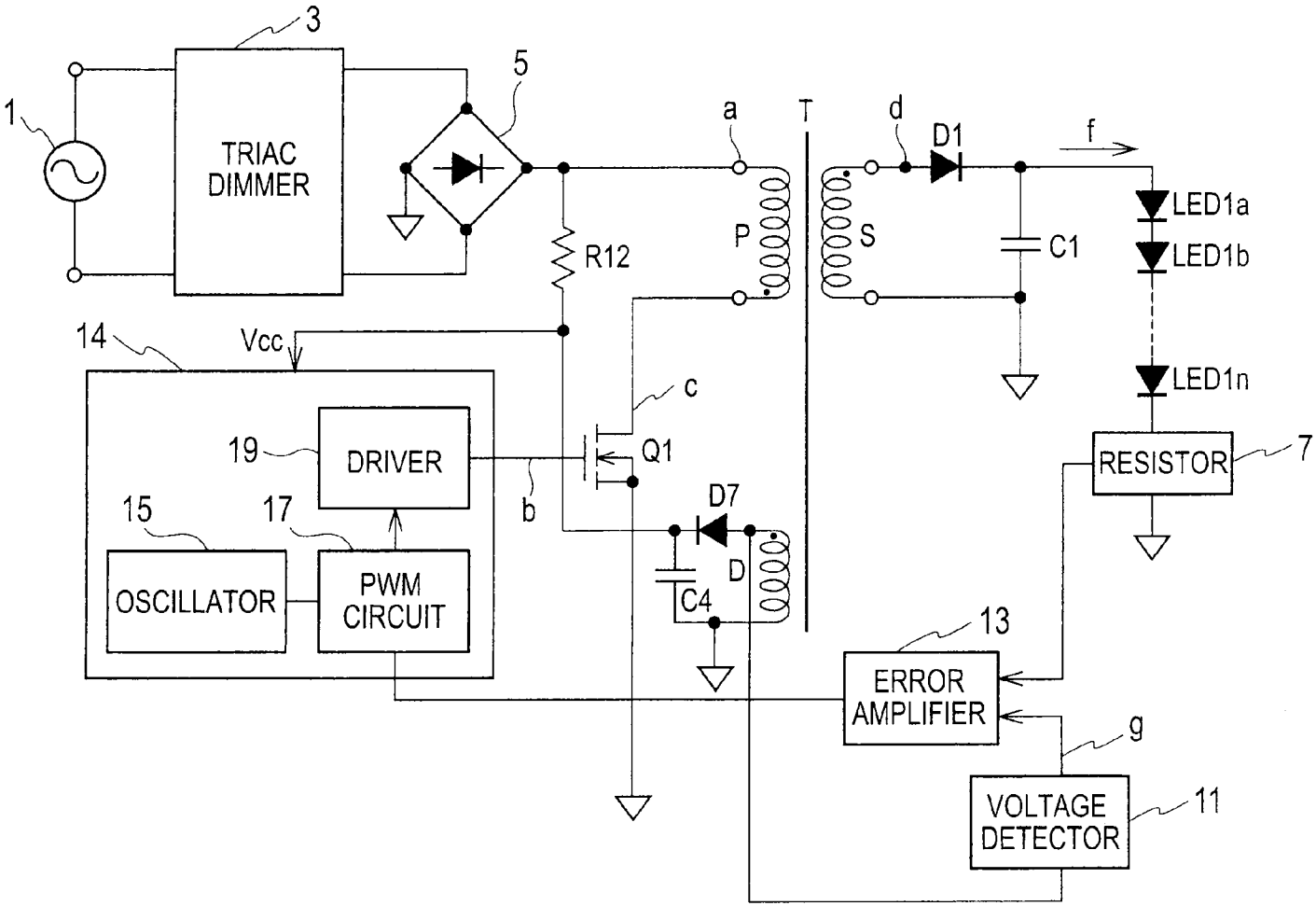
FIG. 6 is a schematic view illustrating an LED lighting apparatus according to Embodiment 3 of the present invention.

FIG. 6 is a schematic view illustrating an LED lighting apparatus according to Embodiment 3 of the present invention. Unlike the LED lighting apparatus of Embodiment 1 illustrated in FIG. 2 that outputs a voltage from the secondary winding S to the voltage detector 11, the LED lighting apparatus of Embodiment 3 illustrated in FIG. 6 outputs a voltage from a tertiary winding D to a voltage detector 11 wherein the tertiary winding D is electromagnetically coupled with a secondary winding S of a switching transformer T and both ends of the tertiary winding D is connected to a series circuit including a diode D7 and a capacitor C4.

The LED lighting apparatus of the present embodiment is a non-insulated LED lighting apparatus in which the primary and secondary sides of the switching transformer T are connected to a common ground.

According to the LED lighting apparatus of Embodiment 3, the tertiary winding D generates a voltage proportional to a voltage generated by the secondary winding S. Accordingly, outputting the voltage of the tertiary winding D to the voltage detector 11 results in performing operation and effect like Embodiment 1.

The present invention is not limited to the LED lighting apparatuses of Embodiments 1 to 3. According to Embodiments 1 to 3, the primary and secondary windings P and S of the switching transformer T are wound in reverse phase. Instead, they may be wound inphase.

In this case too, the voltage detector 11 detects the voltage of the secondary winding S, tertiary winding D, or quaternary winding F of the switching transformer T when the diode D1 is ON and outputs a voltage detection signal. The present invention may employ not only the PWM control technique but also other control techniques using RCC (ringing choke converter), quasi-resonance, ON- or OFF-width fixation, and the like.

Modification

Figure 7:
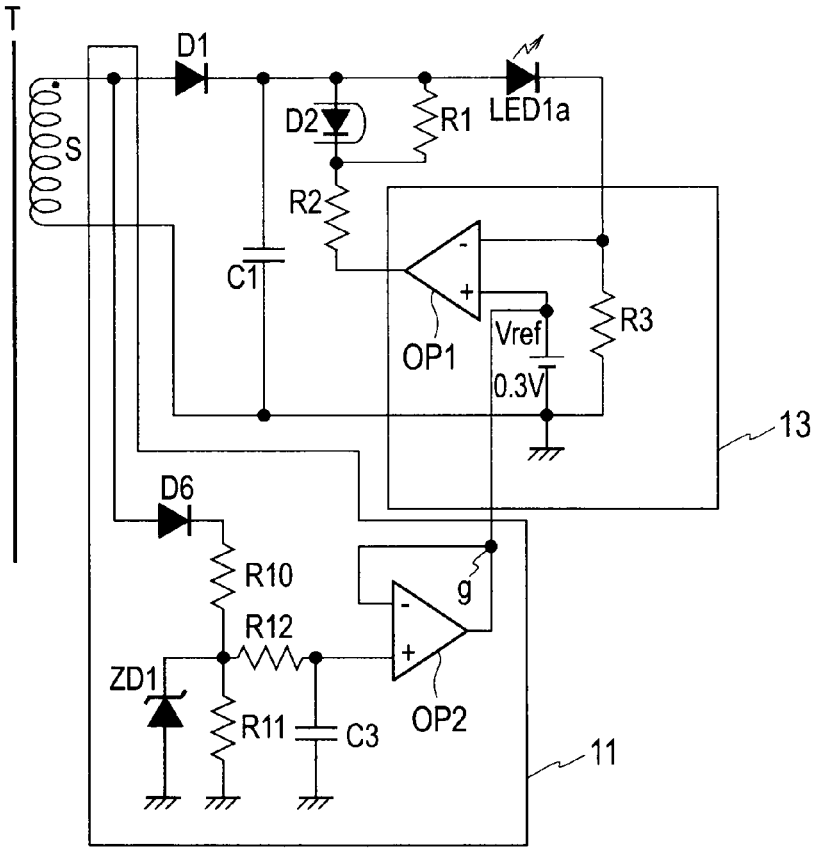
FIG. 7 is a schematic view illustrating an LED lighting apparatus according to a modification of the present invention.

FIG. 7 is a schematic view illustrating a voltage detector 11 according to a modification of the present invention. The voltage detector 11 of the modification differs from the voltage detector 11 of Embodiment 1 illustrated in FIG. 3 in that a zener diode ZD1 is connected in parallel with the resistor R11 of FIG. 3. A zener voltage of the zener diode ZD1 is set so that the zener diode ZD1 causes a zener-breakdown by a winding voltage of the secondary winding S of the switching transformer T.

If the LED element 1 has an I-V characteristic that a forward current gradually changes as a forward voltage changes when a voltage applied to the LED element is higher than a specific forward voltage, the forward voltage will vary according to the forward current (brightness)) even if the LED element keeps ON state. In this case, a peak value of the positive high-frequency winding voltage (waveform d of FIG. 4) of the secondary winding S apparently changes in response to the brightness of the LEDs 1*a* to 1*n*. For example, an LED lighting voltage Vf when the LEDs 1*a* to 1*n* are bright (brightness 1) greatly differs from that when the LEDs 1*a* to 1*n* are dimmed (brightness 2), to vary the peak value of the positive high-frequency winding voltage of the secondary winding S. When the LEDs 1*a* to 1*n* are dimmed, the peak value decreases to decrease the smoothed voltage (waveform e of FIG. 4). In this case, the LEDs 1*a* to 1*n* will not properly be dimmed.

The modification of FIG. 7 solves this problem. The voltage detector 11 according to the modification illustrated in FIG. 7 is hardly affected by variations in the peak value of the high-frequency winding voltage of the secondary winding S of the switching transformer T and correctly detects from the high-frequency winding voltage a phase ratio that is deter mined by a conductive period of the triac dimmer 3 and is applied to an AC input voltage. Accordingly, the voltage detector 11 of the modification allows an LED lighting apparatus employing the same to properly dim LEDs with a triac dimmer without regard to I-V characteristics of the LEDs.

The voltage detector 11 of the modification is applicable to any one of the above-mentioned embodiments.

According to any one of the embodiments and modification mentioned above, the voltage detector 11 outputs a voltage detection signal to the error amplifier 13, the voltage detection signal representing a smoothed form of a high-frequency voltage generated when the diode D1 is ON by the secondary winding S or n-th order winding (n≧3) of the switching transformer T, the high-frequency voltage being proportional to an AC input voltage phase-controlled by the triac dimmer 3 at a given phase ratio and having a peak value substantially equal to or proportional to a voltage applied to the LEDs 1*a* to 1*n*. The error amplifier 13 amplifies an error between the voltage detection signal and a current detection signal from the resistor 7 (R3) and outputs the amplified signal to the controller 14. According to the signal from the error amplifier 13, the controller 14 controls ON/OFF of the switching element Q1.

As a result, the LED lighting apparatus according to anyone of the embodiments and modification reflects a change in an input voltage effective value derived from phase control by the triac dimmer 3 on an LED current passed to the LEDs 1*a* to 1*n* and never reflects a change in an AC input voltage itself on the LED current. The LED lighting apparatus, therefore, is capable of dealing with input voltage variations and a wide range of input voltages when dimming the LEDs 1*a* to 1*n* with the triac dimmer 3.

The present invention is applicable to light LEDs in LED lighting apparatuses and LED illuminating apparatuses.

This application claims benefit of priority under 35 USC §119 to Japanese Patent Application No. 2010-118240, filed on May 24, 2010, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. An LED lighting apparatus comprising:

a triac dimmer configured to phase-control an AC input voltage at a given phase ratio and output a phase-controlled AC voltage;

a series circuit connected to the triac dimmer and including a primary winding of a switching transformer and a switching element, the switching transformer having a plurality of windings;

a controller configured to control ON/OFF of the switching element;

a rectifying-smoothing circuit having a first rectifying element and a first smoothing element and configured to rectify and smooth a voltage generated by a secondary winding of the switching transformer;

LEDs connected to an output of the rectifying-smoothing circuit;

a current detector configured to detect a current passing through the LEDs and output a current detection signal;

a voltage detector configured to output a voltage detection signal proportional to a phase ratio of the AC input voltage, the voltage detection signal being based on a winding voltage generating at the secondary winding of the switching transformer or n-th order winding thereof, and the n-th order winding being electromagnetically coupled with the secondary winding wherein n≧3; and an amplifier configured to amplify a voltage associating with the current detection signal and voltage detection signal and output the amplified voltage to the controller.

2. The LED lighting apparatus of claim 1, further comprising a rectifying circuit having a second rectifying element and configured to rectify the voltage generated by the n-th order winding of the switching transformer.

3. The LED lighting apparatus of claim 2, wherein the rectifying circuit has a second smoothing element configured to smooth the rectified voltage from the second rectifying element and supplies the output voltage of the second smoothing element to the controller as a power source.

* * * * *